US005651521A

United States Patent [19]

Aberg

[11] Patent Number: 5,651,521

[45] Date of Patent: Jul. 29, 1997

[54] CLIP-ON BRACKET

[75] Inventor: Lars Aberg, Walpole, N.H.

[73] Assignee: Nimar, Walpole, N.H.

[21] Appl. No.: 471,732

[22] Filed: Jun. 6, 1995

[51] Int. Cl.[6] ..... A47B 96/06

[52] U.S. Cl. ..... 248/218.4; 248/222.52; 248/303

[58] Field of Search ..... 248/219.3, 218.4, 248/230.1, 217.1, 125.1, 211, 222.51, 302, 303, 304, 231.81, 306; 24/67.9, 546

[56] References Cited

U.S. PATENT DOCUMENTS

| | | | |
|---|---|---|---|
| 962,963 | 6/1910 | Kegler | 248/222.51 |
| 2,429,029 | 10/1947 | Newbern | 248/218.4 |
| 3,064,933 | 11/1962 | Brasty | 248/125.1 |
| 3,302,328 | 2/1967 | King | 248/125.1 |
| 3,381,824 | 5/1968 | Blumenschein | 248/125.1 |
| 3,504,108 | 3/1970 | Kihs | 248/302 |
| 3,669,394 | 6/1972 | Loucks | 248/211 |
| 3,883,934 | 5/1975 | Rochfort | 248/302 |
| 4,742,979 | 5/1988 | Syversten | 248/65 |
| 5,388,709 | 2/1995 | Adams | 248/218.4 |
| 5,476,240 | 12/1995 | McDonough | 248/213.2 |

*Primary Examiner*—Leslie A. Braun
*Assistant Examiner*—Gwendolyn W. Baxter
*Attorney, Agent, or Firm*—Lee A. Strimbeck

[57] ABSTRACT

A bracket useful as a hanger for objects being metal plated consisting of a continuous single rigid wire adapted to removably clip onto a vertical rod. The bracket has a horizontal arm which extends into a downwardly directed curvilinear clasp. The wire then proceeds upwardly from the bottom of the clasp to meet with and support the horizontal arm. The clasp first curves around approximately 180 degrees and is sized at the upper portion to tightly engage the vertical rod. It then curves about in the other direction to form a rest sized to fit against the vertical rod.

5 Claims, 1 Drawing Sheet

CLIP-ON BRACKET

FIELD OF THE INVENTION

The present invention is a clip-on hanger or bracket such as might be used to hold objects for metal plating. It consists of a single rigid wire bent and configured to clip on to a vertical upright.

BACKGROUND OF THE INVENTION

In brief compass this invention is a clip-on hanger consisting of a single wire which is continuous and rigid configured as follows. It has a horizontal arm which at its inner attachment end spirals downwardly into two opposing finger—loops adapted to removably attach to a vertical rod. The wire continues from the bottom most finger loop outwardly and upwardly to connect with and support the horizontal arm. The upper of the finger loops, of which there are usually only two, extends sufficiently around the vertical rod and is sized with respect thereto such that in use it clamps to the vertical rod. The bottom of the finger loops brace against the vertical rod to prevent downward turning of the horizontal arm.

In the preferred embodiment the wire is round and the rod to which it attaches is also round, although it could be square or some other shape.

DESCRIPTION

In the drawings the bracket is generally indicated by the number 10. It has an arm 16 that is generally horizontal in service and ends at its outer end in a hook, 11, of whatever configuration may be desired for the holding of parts, hooks or the like. In some cases it may just be straight and end in a knob.

The wire can be of any convenient diameter for example from 3 to 8/32 of an inch. It will usually be round but it can have some other shape such as square. It is preferably quite rigid.

The inner end of arm 16 spirals downwardly and is bent to grip a rod such as rod 17. It first spirals in one direction to form a clasp or "finger-loop" 12. It then continues downwardly spiralling in the other direction to form another loop 13 which need not firmly grip the supporting rod 17 but does rest there against to prevent downward turning of the horizonal arm. From loop 13 the wire then extends upwardly to form a supporting arm 14 that meets with and is joined to arm 16 at a midpoint 15 thereof. As illustrated, the wires are welded at point 15 although arm 14 could simply be tightly wrapped around arm 16 to support it.

The finger-loops do not spiral completely around the rod. As illustrated, the upper one 12 goes around approximately 180 degrees sufficient to clasp the rod then takes a downwardly U-shaped turn and goes around the rod in the other direction to the lower finger-loop 13. This permits the hanger to be clipped onto the rod from the side of the rod without the need to slide the finger loop over the end of the rod. The lower loop 13 also extends approximately 180 degrees around the rod (as measured from the U-shaped turn of loop 12) and then takes a downwardly U-shaped bend into arm 14.

Horizontal arm 16 can have any length, but will usually be in the range of 3 to 12 inches. The vertical rod, 17, can also have any diameter but a diameter in the range of ¼ to ¾ of an inch will generally be sufficient for most plating operations wherein this clip-on bracket will find application. It is obvious of course that this bracket can be used in many other situations such as serving as a hanging plant holder.

In summary the present invention is a bracket of a continuous rigid wire adapted to removably clip onto a vertical rod. The bracket has a horizontal arm extending into a downwardly directed curvilinear clasp with the wire then proceeding upwardly from the bottom of the clasp to meet with and support the horizontal arm. The wire at the clasp first curves around approximately 180 degrees and is sized at that point to tightly engage the vertical rod. The wire then reversibly curves about to form a rest, sized to fit against the vertical rod, before proceeding upwardly to meet with the horizontal arm.

DRAWINGS

In the drawings.

In the drawings the same numbers are used for the same part or portion throughout the drawings.

Figure 1:
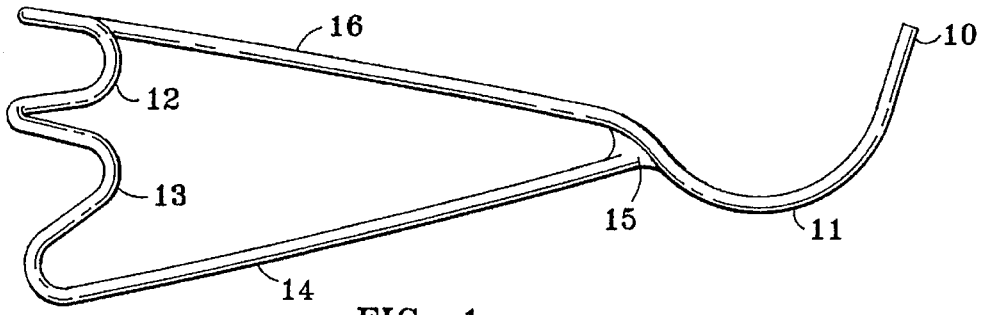
FIG. 1 is an elevation view of one side of the bracket.
Figure 2:
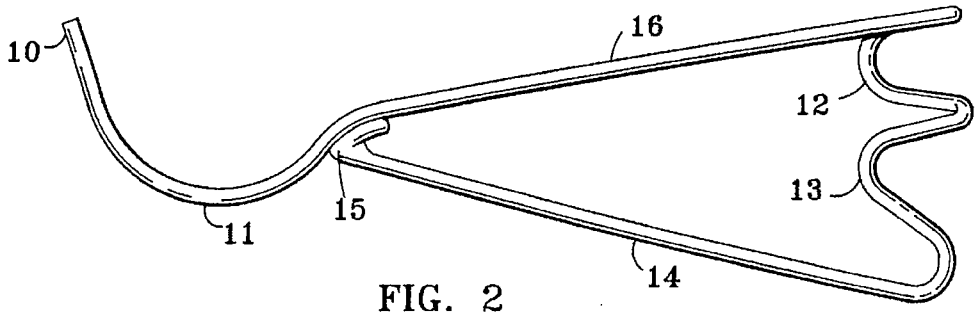
FIG. 2 is an elevation view of the other side.
Figure 3:
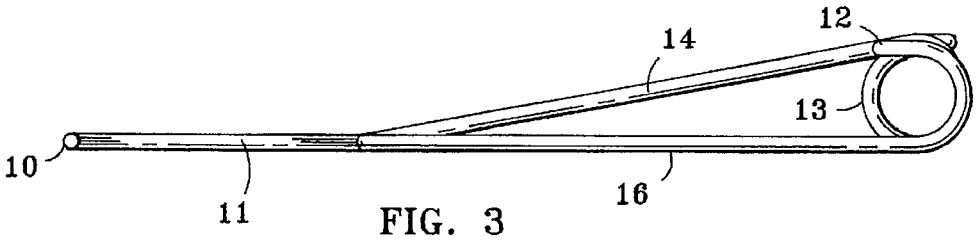
FIG. 3 is a top view.
Figure 4:
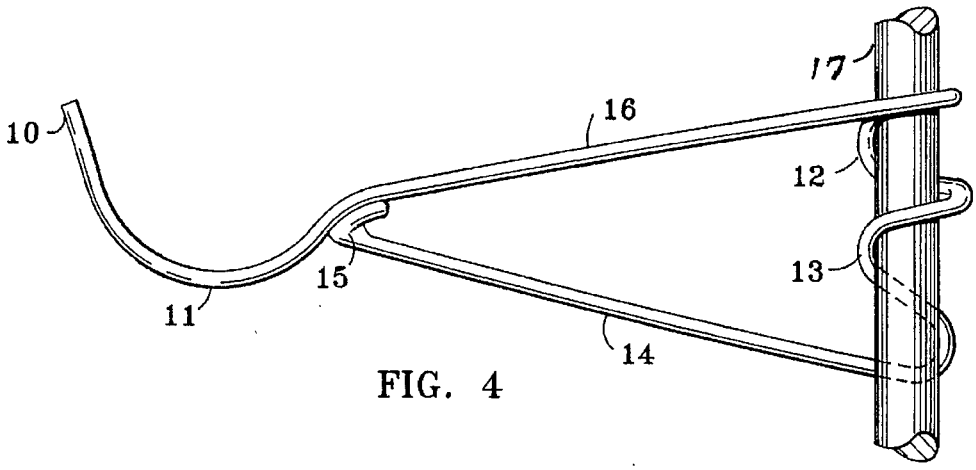
FIG. 4 is a perspective view showing the bracket clipped onto a vertical rod.

What is claimed is:

1. A clip-on hanger consisting of a single wire which is continuous, rigid and configured as follows:

an arm which is generally horizontal in use and has an outer and inner end, which inner end continues and spirals downwardly into two opposing finger-loops adapted to removably attach to a vertical rod, said single wire continuing from the bottom of said finger-loops outwardly and upwardly to said arm, being joined therewith short of said outer end and supporting said arm, the upper of said finger-loops extending sufficiently around said vertical rod and being sized with respect thereto such that in use it clamps to said vertical rod and the bottom of said finger-loops bracing against said vertical rod to prevent a downward turning of said arm.

2. The clip-on hanger of claim 1 wherein said arm extends outwardly in the range of 3 to 12 inches and said single wire is round in cross-section and has a diameter in the range of 3/32 to 8/32 of an inch.

3. The clip-on hanger of claim 2 wherein said vertical rod is round and said finger-loops are sized to accommodate a vertical rod diameter in the range of ¼ to ¾ of an inch.

4. The clip-on hanger of claim 3 wherein said outer end terminates in an upwardly facing hook.

5. A bracket consisting of a continuous rigid wire adapted to removably clip onto a vertical rod, said bracket having a horizontal arm extending into a downwardly directed curvilinear clasp and then proceeding upwardly from the bottom of the clasp to meet with and support said horizontal arm; said clasp first curving around approximately 180 degrees and being sized at the upper portion to tightly engage said vertical rod and then reversely curving about to form a rest sized to fit against said vertical rod.

* * * * *